United States Patent [19]

Kaysserian

[11] Patent Number: 4,765,475

[45] Date of Patent: Aug. 23, 1988

[54] HOLDER AND DISPENSER FOR MULTIPLE ROLLS OF TISSUE

[76] Inventor: Kerry M. Kaysserian, 2615 Green Meadows, Traverse City, Mich. 49684

[21] Appl. No.: 940,427

[22] Filed: Dec. 11, 1986

[51] Int. Cl.[4] ..... B65D 85/62; B65D 85/67

[52] U.S. Cl. ..... 206/394; 206/390; 206/391; 242/55.53

[58] Field of Search ..... 206/389, 391, 394, 390; 242/55.3, 55.53, 55.42, 55.54; 248/DIG. 5; 221/312 A

[56] References Cited

U.S. PATENT DOCUMENTS

| | | | |
|---|---|---|---|
| 2,991,951 | 7/1958 | Carroll | 242/55.42 |
| 3,168,258 | 2/1965 | Schwartz | 242/55.42 |
| 3,316,040 | 4/1967 | McGann | 242/55.3 |
| 3,398,908 | 8/1968 | Thompson | 242/55.3 X |
| 3,484,052 | 12/1969 | Clarke | 242/55.42 |
| 4,098,469 | 7/1978 | McCarthy | 242/55.53 X |
| 4,177,958 | 12/1979 | Poole | 242/55.42 |
| 4,322,042 | 3/1982 | Wormly | 242/55.54 |

*Primary Examiner*—Jimmy G. Foster

*Attorney, Agent, or Firm*—Gerald E. McGlynn, Jr.; Daniel H. Bliss

[57] ABSTRACT

A container (10) for storing and dispensing, one at a time, a plurality of rolls of tissue stacked vertically adjacent one another includes tubular side walls (18,20,22,24) having a longitudinal axis and a pair of end portions (28,32) spaced from each other along the axis and being respectively joined to the side walls (18,20,22,24). One of the end portions (28) is closed to support a roll thereon and the other of the end portions (32) includes an end wall (34) inclined radially inwardly and axially relative to the axis. The end wall (34) defines a generally oval-shaped opening (36) through which to insert the rolls into the container (10) while preventing removal of such a roll from the container (10) through the opening (36).

10 Claims, 2 Drawing Sheets

HOLDER AND DISPENSER FOR MULTIPLE ROLLS OF TISSUE

TECHNICAL FIELD

The subject invention relates to a toilet paper roll storage dispenser.

BACKGROUND ART

Tissue dispensers for holding and dispensing toilet tissue are commonly found in public and private facilities. A typical roll of toilet tissue comprises a series of interconnected tissue panels wound around a cylindrical cardboard tubular insert to form a cylindrical roll of tissue. A conventional tissue dispenser will usually have a support housing for cantilevering the tissue roll and a support rod communicating diametrically through the tissue roll or cardboard tubular insert and secured to the support housing. The support rod may comprise a two-piece construction having a spring plunger to be removably connected to the support housing, or may be pivotally hinged to swing outwardly perpendicularly from the support housing and engageable and disengageable with a retaining device for securing the support rod to the support housing.

The problem with the conventional tissue dispenser is that usually the dispenser is able to hold only a single roll of tissue. Thus, a person may find the dispenser empty in a public facility. Commonly, a conventional dispenser rack may hold two rolls of tissue. However, this dispenser may result in partially used rolls remaining on the rack and resulting in inefficient storage. Further, in a public facility, these tissue rolls are typically unsecured, resulting in the rolls of tissue being removed from the facility for home use or vandalism.

STATEMENT OF THE INVENTION AND ADVANTAGES

A container for storing and dispensing a plurality of rolls of an object to be dispensed includes side wall means having a longitudinal axis, and a pair of end portions spaced from each other along the axis and being respectively joined to the side wall means. One of the end portions is adapted to position a roll for dispensation therefrom. The other end portion includes means defining an opening through which to insert a roll into the container while preventing removal of such a roll from the container through the opening.

Accordingly, the subject invention holds multiple rolls of tissue and prevents another roll of tissue to be used until the first roll of tissue is completely used, resulting in efficient storage. Further, the subject invention prevents vandalism of the tissue rolls since they are secured in a closed housing and cannot be removed until the tissue rolls are completely used.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
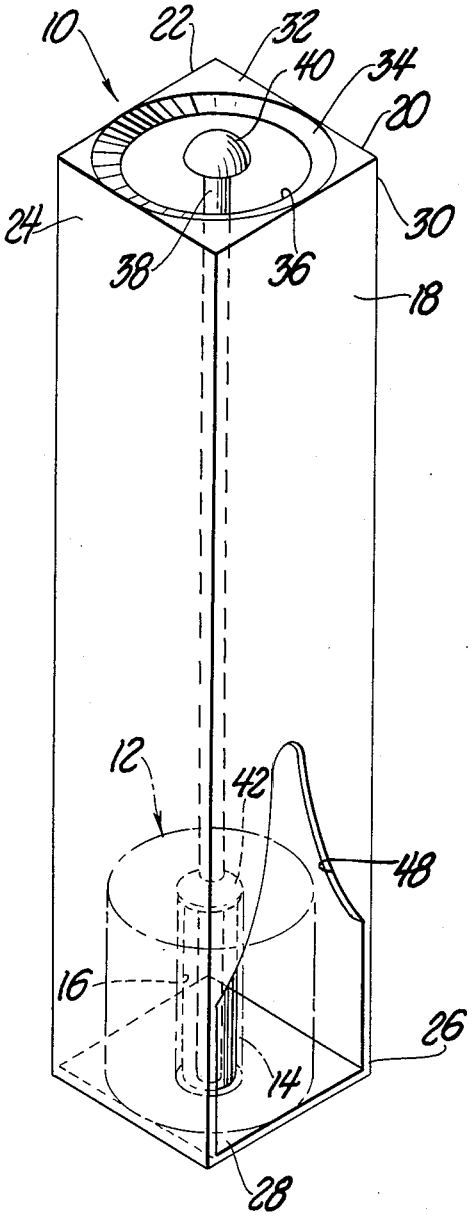
FIG. 1 is a perspective view of a preferred embodiment of the subject invention illustrating, in phantom lines, a roll of tissue to be dispensed therefrom.

A container for storing and dispensing one at a time a plurality of rolls of an object such as tissue stacked vertically adjacent one another within the container is generally shown at 10 in FIG. 1. The rolls of tissue are conventional in nature and are of the type comprising a series of interconnected tissue panels, adapted to be torn from each other, and wound in a generally cylindrical shape, the initial shape being indicated at 12, about a central generally cylindrical core element 14 having a central generally cylindrical passage 16 extending axially therethrough. The core element 14 is typically made of a suitable fibrous paper construction.

At this juncture, it should be noted that a typical roll of tissue has, as aforementioned, a generally cylindrical shape 12 which is of uniform diameter, and the core element 14 defining the central passage 16 is likewise of generally cylindrical shape having a uniform diameter. Yet, the body of tissue and the core element 14 are sufficiently flexible so as to be radially distorted for a purpose to appear more fully hereinafter.

The container 10 includes a tubular side wall means which, in the preferred embodiment, consists of four side walls 18,20,22,24 suitably joined together to form a housing. The tubular side wall means has a longitudinal axis. A first or lower end portion 26 of the housing or container 10 is spaced along the axis and includes a lower end wall 28 suitably joined to the side walls 18,20,22,24 to close the lower end portion 26 of the container 10. In other words, the lower end portion 26 of the container 10 is closed by lower end wall means 28 to support a roll thereon.

The other or upper end portion 30 of the container 10 is spaced from the lower end portion 26 along the axis and is respectively joined to the side wall means. The upper end portion 30 includes an upper end wall 32 having a continuous inner wall member 34 which is inclined radially inwardly and axially downwardly relative to the axis of the container 10 and toward the lower end portion 28 thereof closed by the lower end wall 28. Stated another way, the upper end portion 30 includes upper end wall means 32,34 inclined radially inwardly and axially relative to the axis and lower closed end portion 28. The inner wall member 34 defines a generally oval-shaped supply opening 36 through which successive rolls of tissue may be inserted into the container 10 along the longitudinal axis thereof.

The opening 36 has a minor diameter smaller than the diameter of a roll and a major diameter greater than the diameter of a roll. A given roll may be distorted to a generally oval shape for insertion through the opening 36 into the container 10. The upper end wall means 32,34 defines the supply opening 36 which prevents removal of the roll from the container 10 through the opening 36.

Figure 2:
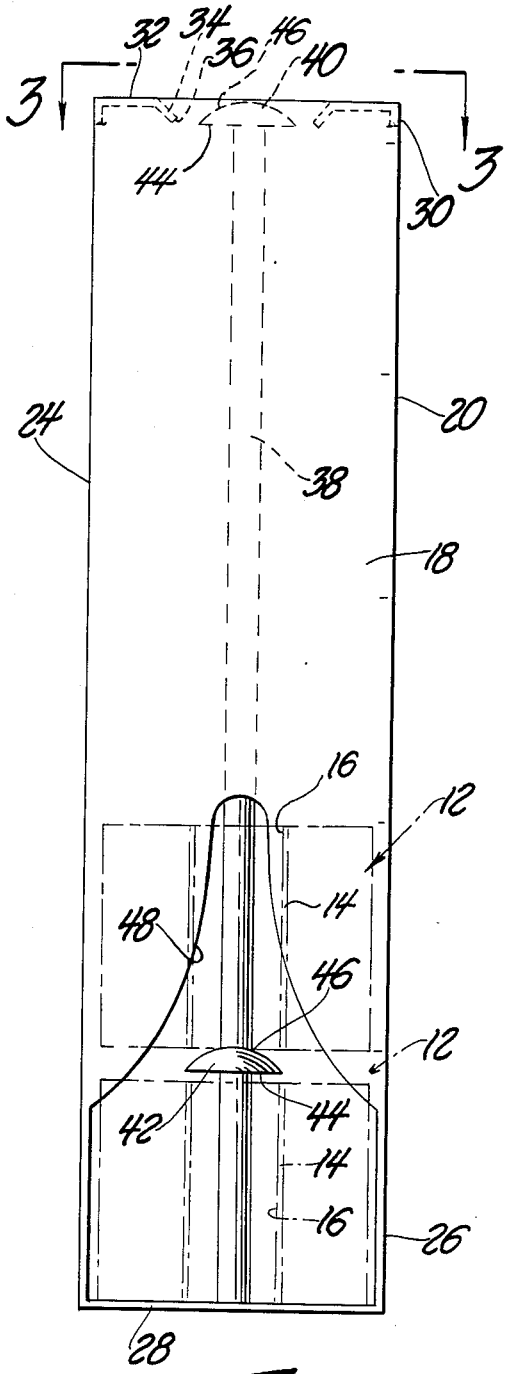
FIG. 2 is a side elevational view of the subject invention in accordance with the preferred embodiment illustrating, in phantom lines, a pair of the rolls of tissue to be stored in and dispensed therefrom.
Figure 3:
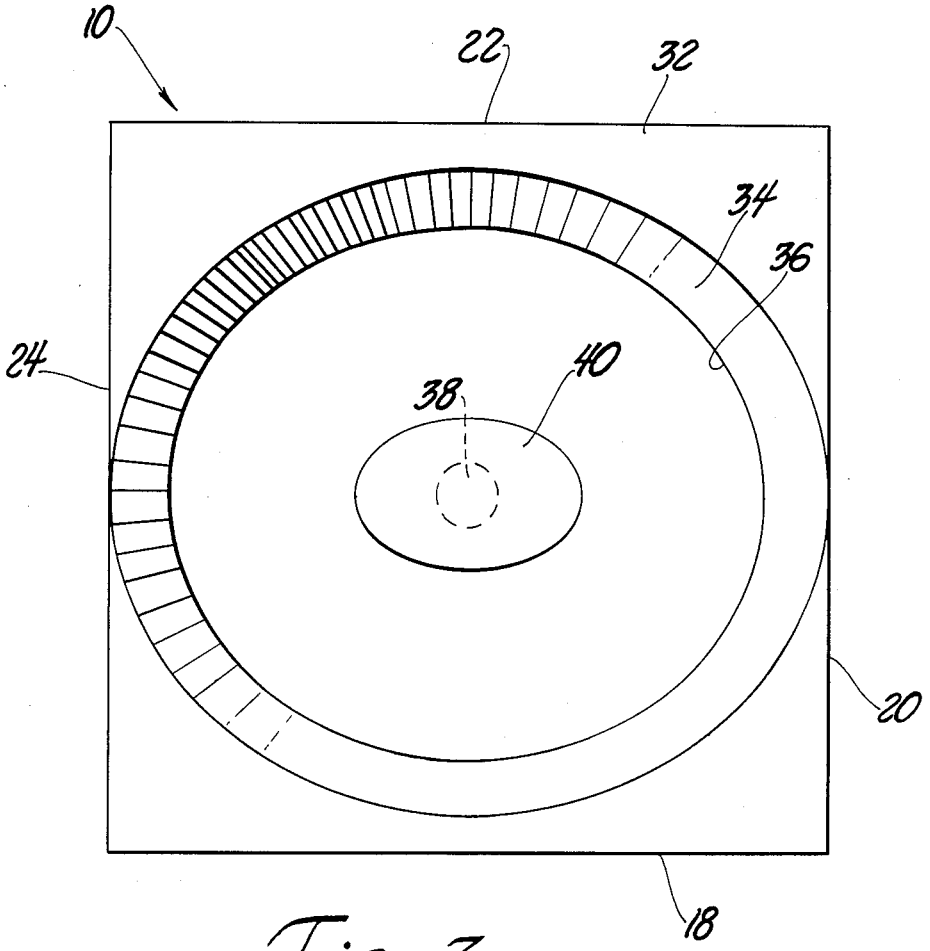
FIG. 3 is a plan view taken substantially along line 3—3 of FIG. 2.

A support rod means 38, in this case circular in cross section, has its lower end fixedly secured by any suitable means to the lower end wall 28 disposed at the closed lower end portion 26 of the container 10. The rod means 38 extends substantially coaxially along the longitudinal axis of the container 10 toward the upper end wall means 32,34 at the upper end portion 30 of the container 10, and terminates adjacent the opening 36 in the latter. A first plug means 40 and second plug means 42 are generally oval-shaped and suitably fixedly secured to the rod 38 in spaced relationship to each other. More specifically, the second plug means 42 is secured to the rod 38 above the lower end wall 28 a sufficient distance to position a roll of tissue therebetween to be supported on the closed end wall 28 of the container 10 as best illustrated in FIGS. 1 and 2. In addition, the second plug means 42 functions to support another roll of tissue, and in the preferred embodiment illustrated, three additional rolls of tissue, above in vertically spaced adjacent relationship to the roll of tissue positioned between the plug means 42 and the lower end wall 28 in the lower end portion 26 of the container 10.

The second plug means 42 has a minor diameter smaller than the diameter of the central passage 16 in the core element 14 of a roll, and a major diameter greater than the diameter of the central passage 16 in the core element 14. The core element 14 of a roll may be distorted to a generally oval shape for movement past the second plug means 42 to a position in which it is supported within the closed lower end portion 26 of the container 10.

The first plug means 40 is disposed at the upper end of the rod 38 in substantially the same plane as or adjacent to the supply opening 36 with respect to the longitudinal axis of the container 10 along which the rod 38 is disposed. The first plug means 40 has a minor diameter smaller than the diameter of the central passage 16 in the core element 14 of a roll and a major diameter greater than the diameter of the central passage 16 in the core element 14 of a roll. The core element 14 of a given roll may be distorted to a generally oval shape for insertion past the first plug means 40 into the container 10 while the first plug means 40 prevents removal of the roll from the container 10 through the supply opening 36.

First plug member 40 and second plug member 42 are preferably identical to each other and are parti-spherical in nature in including a plane base surface 44 joined to a parti-spherical or convex surface 46.

As best illustrated in FIGS. 1 and 2, one of the side wall members 18 forming the tubular side wall means of the container 10 includes means defining an access opening 48 therein extending from the lower end portion 26 of the container 10 upwardly toward the upper end portion 30 thereof and being of a sufficient size or extent as to substantially fully expose a roll of tissue disposed in the container 10 beneath the second plug means 42 while further exposing a sufficient portion of a roll of tissue disposed above the second plug means 42 to permit manipulation of such a roll past the plug means 42 into the lower position after a roll of tissue has been completely used or otherwise removed from its position in the container 10. In other words, the access opening 48 must be of a sufficient size to remove tissue panels from a first roll supported within the lower closed end portion 26 of the container 10 and also to remove the residue or core element 14 of the first roll and move another roll past the second plug means 42 into the position previously occupied by the residue or core element 14 of such first roll.

In operation, the container 10 is loaded with a desired number of the rolls of tissue which, in the preferred embodiment, would be the maximum of five rolls. The rolls are inserted, one at a time, through the supply opening 36 in the upper end wall 32 of the container 10 and about the rod 38. In so loading each roll of tissue, the roll is manually distorted radially so that the outer peripheral configuration of a roll assumes the oval configuration of the supply opening 36 which acts as a funnel to guide the roll through the supply opening 36 and about the rod 38. At the same time, the core element 14 of the roll is similarly distorted into an oval shape so as to pass beyond the first plug means 40.

After the first roll of tissue is inserted through the supply opening 36, it will fall by gravity to rest upon the second plug means 42; thatis, in the position illustrated in phantom line in FIG. 2 above the second plug means 42. Thereafter, the roll may be manually distorted by reaching through the access opening 48 to distort the core element 14 into the oval shape of the second plug means 42 so as to be moved past the latter into the lowermost position indicated in phantom line in FIG. 2. In this position, the roll rests upon the lower end wall 28. Morever, the core element 14 returns to its generally cylindrical shape 12 having a uniform diameter and is locked beneath the plane lower surface 44 of the plug means 42.

Thereafter, additional rolls of tissue, up to a maximum of four additional rolls in the illustrated embodiment, may be inserted in the same fashion through the supply opening 36 and past the first plug means 40. As each roll is so inserted, it falls upon and rests against the immediately preceding roll of tissue which has been previously inserted. The result is a lowermost roll being disposed beneath the second plug means 42 and resting on the lower end wall 28 as illustrated in FIG. 2, a second roll member being supported upon the parti-spherical or convex surface 46 of the second plug means 42 and the remaining three rolls being vertically stacked upon each other and upon the roll supported by the second plug means 42.

In this regard, it is to be noted that the uppermost roll, or any roll for that matter, may not be removed through the supply opening 36 once it is inserted into the container 10. In other words, after distortion for the purpose of passing through the supply opening 36 and past plug means 40 into the container 10, the rolls tend to resume their original shape 12 and the arrangement of the oval-shaped supply opening 36 and plug means 40 with respect to such shape prevents manual access to a roll to distort it to remove the roll past the first plug means 40 and upper end wall means 32,34 through the opening 36.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A container for storing and dispensing a plurality of rolls of an object to be dispensed comprising side wall means having a longitudinal axis, and a pair of end portions spaced from each other along said axis and being respectively joined to said side wall means, one of said end portions being adapted to position one of said rolls for dispensation therefrom, the other of said end portions including end wall means immovably joined to said side wall means and defining an opening of a size to permit insertion of said rolls into said container, said end wall means cooperating with said opening to prevent removal of said rolls from said container through said opening.

2. The invention as defined in claim 1 including plug means operatively fixedly secured to said container adjacent to the position which a first roll occupies in said one of said end portions of said container and being operable to support a second roll immediately adjacent to the position of the first roll.

3. The invention as defined in claim 1 including rod means operatively fixedly secured to said container and extending coaxially with said axis between said end portions thereof, and a generally oval-shaped plug means fixedly secured to said rod means in adjacent spaced relation to the position which a first roll occupies in said one of said end portions of said container to support a second roll in spaced relationship to such first roll and whereby the central passage of the second roll may be distorted to a generally oval shape for movement past said plug means to the position previously occupied by the first roll.

4. The invention as defined in claim 3 wherein said plug means has a minor diameter smaller than the diameter of the central passage of a roll and a major diameter greater than the diameter of the central passage of a roll.

5. The invention as defined in claim 1 including rod means operatively fixedly secured to said container and extending substantially coaxially with said axis between said end portions thereof, a generally oval-shaped plug means fixedly secured to said rod means in adjacent spaced relation to said one end portion of said container to support a roll in adjacent relationship to a roll to be supported within said one end portion of said container, the central passage of a roll being distortable to a generally oval shape for movement past said plug means to a position in which it is supported by said one end portion of said container, and means on said side wall portion of said container defining an access opening therein extending from said one end portion of said container toward said other end portion of said container and being of sufficient size to enable removable of the residue of a roll supported within said one end portion of said container through said side wall means and move another roll past said plug means into the position previously occupied by the roll removed from said one end portion of said container.

6. A container for storing and dispensing a plurality of rolls of tissue having a generally cylindrical shape; said container comprising side wall means having a longitudinal axis, and a pair of end portions spaced from each other along said axis and being respectively joined to said side wall means, one of said end portions being adapted to position a roll of tissue for dispensing tissue panels therefrom, the other of said end portions including end wall means inclined radially inwardly and axially relative to said axis and toward said one of said end portions to define a generally oval-shaped opening through which to insert a roll into said container, said opening having a minor diameter smaller than the diameter of the roll and a major diameter greater than the diameter of the roll whereby a given roll may be distorted to a generally oval shape for insertion through said opening into said container while said end wall means prevents removal of the roll from said container through said opening.

7. A container for storing and dispensing a plurality of rolls of an object to be dispensed comprising side wall means having a longitudinal axis, a pair of end portions spaced from each other along said axis and being respectively joined to said side wall means, one of said end portions being adapted to position one of said rolls for dispensing tissue panels therefrom, the other of said end portions including end wall means immovably joined to said side wall means and defining an opening of a size to permit insertion of said rolls into said container, said end wall means cooperating with said opening to prevent removal of said rolls from said container through said opening, and plug means operatively fixedly secured to said container adjacent to said opening whereby one of said rolls may be inserted pass said plug means into said container while said plug means prevent removal of said rolls from said container through said opening.

8. A container for storing and dispensing a plurality of rolls of tissue having a general cylindrical passage extending therethrough; said container comprising side wall means having a longitudinal axis, a pair of end portions spaced from each other along said axis and being respectively joined to said side wall means, one of said end portions being adapted to position one of said rolls of tissue for dispensing tissue panels therefrom, the other of said end portions including end wall means inclined radially inwardly and axially relative to said axis and toward said one of said end portions to define a generally oval-shaped opening through which to insert one of said rolls into said container, rod means operatively fixedly secured to said container and extending substantially coaxially with said axis between said end portions and terminating adjacent said opening, and generally oval-shaped plug means fixedly secured to said rod means adjacent to said opening whereby the central passage of one of said rolls may be distorted to a generally oval shape for insertion through said opening and past said plug means into said container while said plug means prevents removal of said rolls from said container through said opening.

9. The invention as defined in claim 8 wherein said plug means has a minor diameter smaller than the diameter of the central passage of a roll and a major diameter greater than the diameter of the central passage of a roll.

10. A container for storing and dispensing one at a time a plurality of rolls of tissue stacked vertically adjacent one another and of the type having a series of interconnected tissue panels wound in a generally cylindrical shape about a central generally cylindrical core element having a central generally cylindrical passage extending therethrough; said container comprising tubular side wall means having a longitudinal axis, a pair of end portions spaced from each other along said axis and being respectively joined to said side wall means, one of said end portions being closed by end wall means to support a roll thereon, the other of said end portions including end wall means inclined radially inwardly and axially relative to said axis and toward said closed end portion to define a generally oval-shaped supply opening through which to insert the rolls into said container, said opening having a minor diameter smaller than the diameter of a roll and a major diameter greater than the diameter of a roll whereby a given roll may be distorted to a generally oval shape for insertion through said opening into said container while said end wall means defining said supply opening prevents removal of the roll from said container through said opening, rod means fixedly secured to said closed end portion of said container and extending substantially coaxially with the axis of the latter toward said other end portion and terminating adjacent said supply opening, a first generally oval-shaped plug means fixedly secured to said rod means adjacent to said supply opening and having a minor diameter smaller than the diameter of the central passage in the core element of a roll and a major diameter greater than the diameter of the central passage in the core element of a roll whereby the core element of a given roll may be distorted to a generally oval shape for insertion past said first plug means into said container while said first plug means prevents removal of the roll from said container through said supply opening, said first plug means being disposed in substantially the same plane as said supply opening relative to said container axis, and a second generally oval-shaped plug means fixedly secured to said rod means in spaced relation to said closed end portion of said container to support a roll in adjacent relationship to the roll to be supported within said closed end portion of said container, said second plug means having a minor diameter smaller than the diameter of the central passage in the core element of a roll and a major diameter greater than the diameter of the central passage in the core element of a roll whereby said second plug means is operable to support a roll in vertically spaced adjacent relationship to a roll supported within said closed end portion of said container and the core element of a roll may be distorted to a generally oval shape for movement past said second plug means to a position in which it is supported within said closed end portion of said container, said side wall means of said container defining an access opening therein extending from said closed end portion of said container toward said other end portion thereof and being of sufficient size to remove tissue panels from a first roll supported within said closed end portion of said container and also to remove the residue of said first roll and move another roll past said second plug means into the position previously occupied by the residue of such first roll.

* * * * *